US010322054B2

(12) United States Patent
McGrath et al.

(10) Patent No.: US 10,322,054 B2
(45) Date of Patent: Jun. 18, 2019

(54) WALKER WITH INSTABILITY WARNING

(71) Applicants: Mitchelle G. McGrath, Farmington, CT (US); Deborah Martinez, Bloomfield, CT (US)

(72) Inventors: Mitchelle G. McGrath, Farmington, CT (US); Deborah Martinez, Bloomfield, CT (US)

( * ) Notice: Subject to any disclaimer, the term of this patent is extended or adjusted under 35 U.S.C. 154(b) by 0 days.

(21) Appl. No.: 15/714,215

(22) Filed: Sep. 25, 2017

(65) Prior Publication Data

US 2019/0091092 A1 Mar. 28, 2019

(51) Int. Cl.
*A61H 3/00* (2006.01)
*G08B 21/04* (2006.01)

(52) U.S. Cl.
CPC ..... *A61H 3/00* (2013.01); *G08B 21/0461* (2013.01); *A61H 2201/0184* (2013.01); *A61H 2201/5058* (2013.01)

(58) Field of Classification Search
CPC ..... A61H 3/00; A61H 2201/0184; A61H 2201/5058; G08B 21/0461
See application file for complete search history.

(56) References Cited

U.S. PATENT DOCUMENTS 5,311,880 A * 5/1994 Lancaster ..... A61B 5/1036 135/67
5,477,211 A 12/1995 Reynolds
5,853,219 A 12/1998 Santuccio
6,963,286 B2 11/2005 Marquis et al.
7,901,368 B2 * 3/2011 Flaherty ..... A61H 1/0255 601/33
8,154,416 B1 4/2012 Olson
8,203,454 B2 6/2012 Knight et al.
8,608,183 B2 12/2013 Woo
8,810,407 B1 * 8/2014 Nolan ..... A61H 3/02 340/407.1
9,180,063 B2 * 11/2015 Friedman ..... G08C 17/02
9,186,289 B2 * 11/2015 Nicholas ..... B62H 1/06
2012/0085378 A1 * 4/2012 Chakraborty ..... A45B 3/04 135/66
2014/0109944 A1 * 4/2014 Triolo ..... A61H 3/00 135/67
2016/0338898 A1 * 11/2016 Wilson ..... A61H 3/00

* cited by examiner

*Primary Examiner* — Noah Chandler Hawk
(74) *Attorney, Agent, or Firm* — Alix, Yale & Ristas, LLP

(57) ABSTRACT

On a safety walker that has two handles situated for grasping by the user while pushing or step-wise advancing the walker, a sensor is situated on each handle at a position where the user grasps the handles in use, for sensing hand proximity or pressure on each handle. A transmitter is associated with each sensor. A signal generator is responsive to the transmitters, for producing a warning signal to the user, when the user has only one hand on the handle. Thus, at least one signal generator is responsive to the transmitters, for producing a warning signal to the user when the sensor on one handle senses a hand and the sensor on the other handle does not sense a hand on the other handle. The system provides a warning before a dangerous tilt or fall is imminent.

10 Claims, 6 Drawing Sheets

WALKER WITH INSTABILITY WARNING

BACKGROUND

The present invention relates to safety walkers, of the type used by persons who have difficulty walking in either their homes or a patient care facility.

Although safety walkers are manufactured with stability and ease of use as paramount considerations, two main reasons exist for why users can destabilize the walker, with the potential for falling or otherwise injuring themselves. One reason is that during use, especially in a patient care facility, the user becomes disoriented, experiences weakness in the arms or legs, becomes distracted, etc. Another reason that arises in both the patient care facilities and in a home context is the user becoming very familiar with the walker and consequently becoming less careful and cautious during use.

Known walkers provide instability feedback to the user, and in the event of an emergency situation, automatically notify a remote caretaker that an emergency, such as a fall, has occurred. The prior efforts typically produce an alarm or the like when the position or orientation of the walker is in a potentially dangerous condition, such as tilting, or when the user is likely to be in a dangerous condition, such as having fallen.

Examples for alarms for walkers include U.S. Pat. Nos. 5,853,219; 5,477,211; 8,608,183. Sensors, transmitters, and signal processing components associated with alarm systems suitable for walkers and wheel chairs are disclosed in U.S. Pat. Nos. 6,963,286; 8,154,416; and 8,203,454. The disclosures of these patents are incorporated herein, to the extent as may be necessary to provide details on the operations of such components. In addition, Posey Products, LLC of Arcadia, Calif., is a supplier of alarm sensors and accessories used in the field of patient safety.

SUMMARY

Unlike known alarm systems for safety walkers, the present invention is focused on warning the user of a potential for a dangerous condition, before such condition occurs.

Every safety walker has two handles situated for grasping by the user while pushing or step-wise advancing the walker. According to the present disclosure, a sensor is situated on each handle at a position where the user grasps the handles in use, for sensing hand proximity or pressure on each handle (collectively, "tactile sensors"). A transmitter is associated with each sensor. A signal generator is responsive to the transmitters, for producing a warning signal to the user, when the user has only one hand on the handle. Thus, at least one signal generator is responsive to the transmitters, for producing a warning signal to the user when the sensor on one handle senses a hand and the sensor on the other handle does not sense a hand on the other handle.

The walker according to the present disclosure can be adapted to include a remote warning or alarm, to notify a caregiver, or attendant in a patient facility, that either the user is not being careful in the use of the walker, or, as in known systems, generating an alarm when, after both of the users hands have been on the walker, one hand comes off and rather than the user recovering within a specified time delay by re-establishing contact with both hands, the user disengages both hands, indicating a possible fall.

In a straight forward embodiment, one signal generator is operatively connected to each sensor. Each signal generator is situated on a respective handle and produces an output that, depending on the circumstances, can be merely neutral, an audio signal, and/or a visual signal. The warning signal is perceived by the user as a difference in the output between the signal generators on the two handles. Once the warning system is armed, this difference could be that one output is silent whereas the other output produces an audio or visual signal; or with both outputs showing the same or no color while the system is armed, removal of the hand from one of the handles changes or illuminates the color on the output associated with the affected handle.

Walkers are most often used by elderly persons who frequently react negatively to changes in their routines and are easily started. One particularly effective kind of output that warns but does not alarm the user, is the playing of a recorded, relatively soothing voice message to re-grip the handle. For persons who have become accustomed to grasping an uninterrupted cylindrical handle portion, at least the sensor can be covered by a soft cylindrical sleeve overlying the walker handle, with a hidden connection to a signal generator that projects through or is spaced from the sleeve.

More complex logic schemes can be used or added for optimizing the performance of the system, including a control system and/or remote alarming. One such control system includes a circuit or programmed processor that receives input from each sensor and selectively generates an output on one component, such as a speaker with pre-recorded warning message. Such controller has an idle mode, where no warning signal is generated if no hand pressure is sensed for a pre-established, long idle period of time. Upon the sensing of hand pressure on at least one of the handles, the controller enters an activated mode. While in the activated mode and upon sensing hand pressure on both handles, the controller enters an armed mode. While in the armed mode, the signal generator produces the warning signal to the user when the sensor on one hand senses hand pressure and the sensor on the other hand does not sense hand pressure.

The invention can take the form of a kit that owners or purchasers of walkers (or their caretakers) can easily back-fit onto a standard walker. The kit includes two sensors with associated transmitters, a connection to one or two signal generators, and convenient means for attaching the components to each other and to the walker.

DETAILED DESCRIPTION

Figure 1:
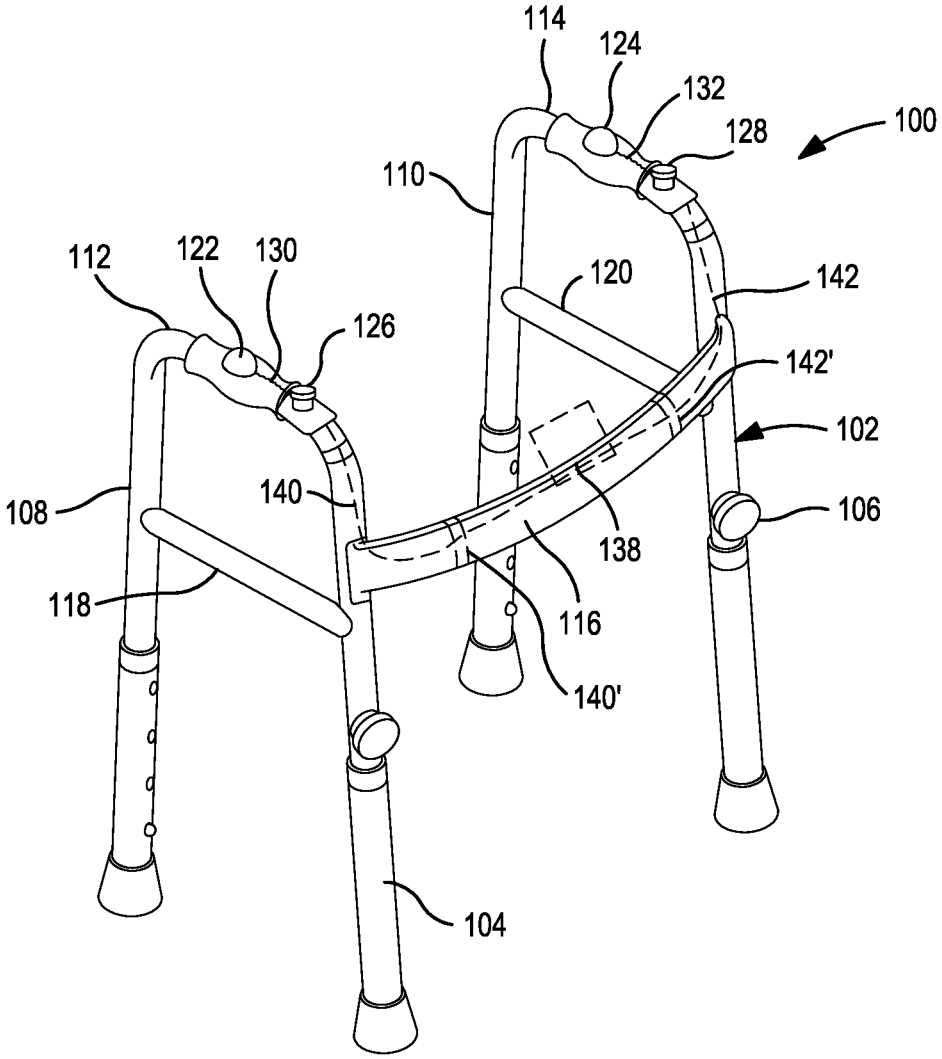
FIG. 1 shows a walker of a type having four upright legs with relatively soft feet, whereby the user sequentially lifts, advances, and resets the walker, and including one embodiment of the inventive instability warning system.
Figure 2:
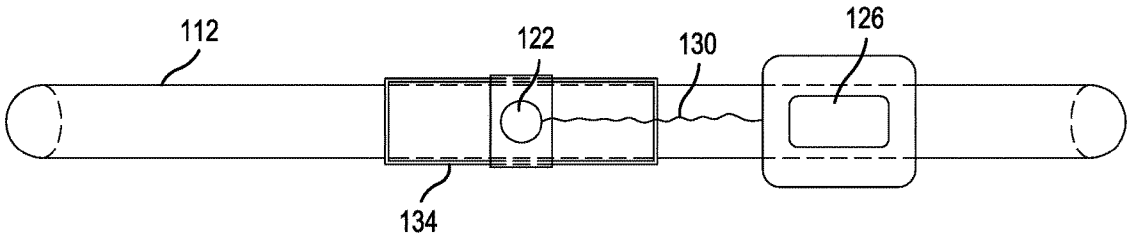
FIG. 2 shows a plane view.
Figure 3:
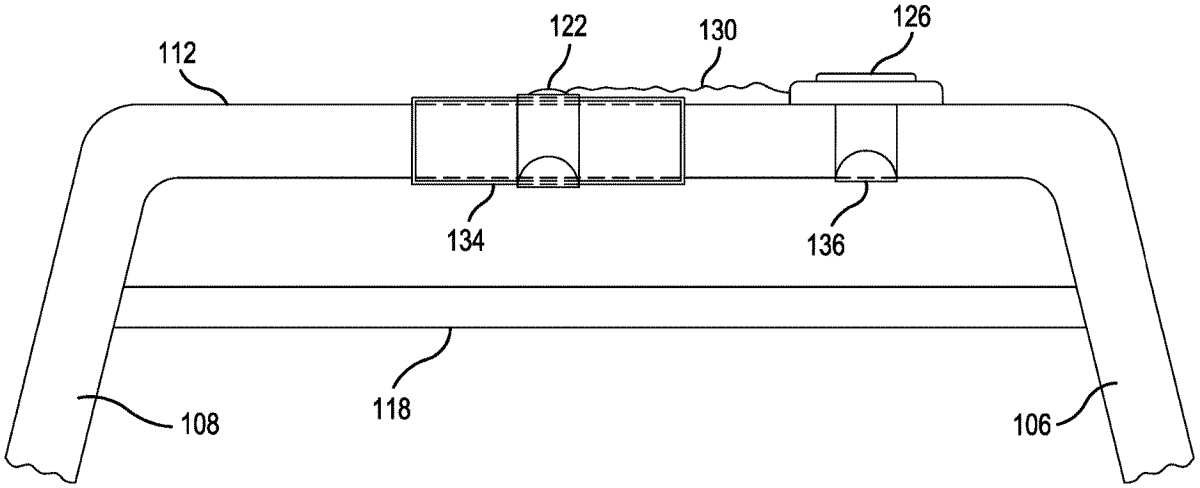
FIG. 3 shows an elevation view, of one of the two handles shown in FIG. 1, each handle having a tactile sensor and an associated output device.

FIGS. 1-3 show a first embodiment 100 of the warning system on a first type of walker 102. The walker includes a pair of spaced apart side frames, each having an inverted U-shape with a front vertical leg 104, 106, a rear vertical leg 108, 110, and a connecting handle spanning the legs 112, 114. A horizontal cross bar 116 connects the front legs, and a strut 18, 120 is secured between the front and rear leg of each side frame, thereby forming a light weight three sided structure that can be deployed by entering from the rear grasping the handles, and stepwise walking while holding both handles. A tactile sensor 122, 124, preferably a pressure sensor, is situated on each handle, at a position where the user grasps the handle during deployment, for sensing hand pressure on each handle. A transmitter is associated with each sensor (typically integrated). A signal generator 126, 128 (output device) is in communication with a respective the transmitter (such as via wires 130, 132), for producing a warning signal to the user when the sensor on one handle senses hand pressure and the sensor on the other handle does not sense hand pressure.

In the embodiment illustrated in FIGS. 2 and 3 one signal generator such as 126 is operatively connected to each sensor such as 122, for generating a respective output. When the user's hands are covering both sensors, both output devices could be in a neutral condition, or in a similar condition such as showing the same color in a display window. But, when the user removes one hand from a sensor, the associated output device produces a signal that is different from the other output device, such as a sound or a different color.

It should be appreciated that the tactile sensor can range from a proximity sensor, whereby the hand may be on the handle but not pressing down whereby the system considers the handle to be grasped, to an actual pressure sensor with the activation pressure selected according to either a typical or customized end user. The warning system can be integrated by the original equipment manufacturer, or, as shown in FIGS. 2 and 3, the sensor 122 and signal generator 126 can be carried by a strap 134, 136 or other mounting at the position on the handle 112 where the user grasps the handle while deploying the walker and the signal generator can likewise be readily attached toward the front of the walker for easy visualization, and connected to the transmitter either via hardwire or wireless connection.

FIG. 1 shows with broken lines, where a single, central signal output device 138 for generating an audible or visual alarm can be located on the cross bar 116 joining the upper ends of the front legs. This supports a more flexible logic than the independent sensor/signal generator system of FIGS. 2 and 3. A communications link 140, 142 is provided between each sensor/transmitter 122, 124 and the signal generator 138. This can be in the form of wires secured with clips 140', 142' to the handles and cross bar. A controller associated with the signal generator (typically integrated) can be programmed to impose a pre-established user recovery delay, such as five seconds, before the signal generator produces the warning signal. This can avoid spurious warnings when the user promptly reestablishes contact with both handles.

Figure 4:
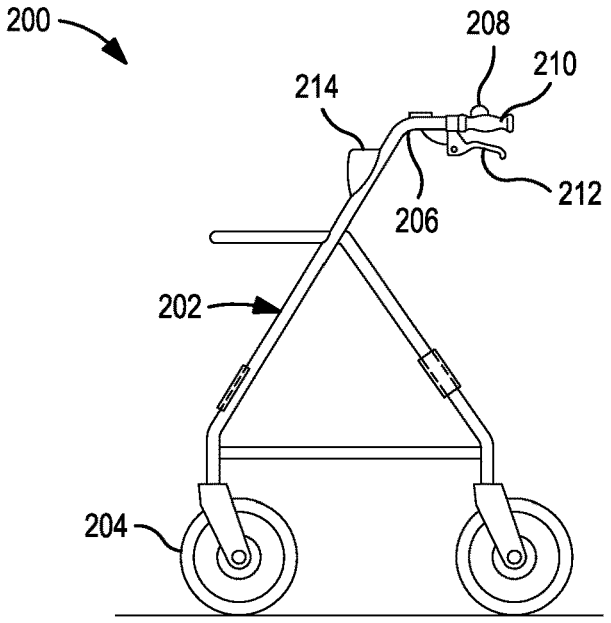
FIG. 4 shows a different type of walker, with four legs, each having a wheel, and a different embodiment of the warning system which has a single output device responsive to each of the sensors on the two handles.

FIG. 4 shows a second type of walker 200, which also has a frame 202 including two front legs, two rear legs, a plurality of struts connecting and bracing the legs, but with wheels 204 on each leg. A pair of spaced a part handles 206 (one shown) are supported by the frame, situated for grasping by the user while pushing the walker as the wheels rotate. A tactile sensor 208 is situated on or within a grip 210 each handle where the user grasps the handles while pushing the walker or applying the brake 212, for sensing hand pressure on each handle. In this embodiment of the warning system, one signal generator 214 is responsive to both transmitters. The signal generator can be carried by one of the legs or a cross bar (not shown).

Figure 5:
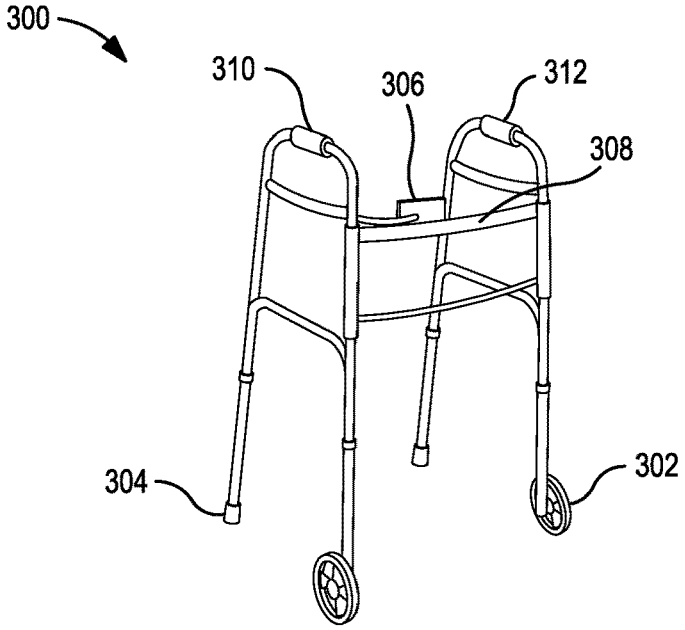
FIG. 5 shows a third type of walker that is a hybrid of the walkers shown in FIG. 1 and FIG. 4 wherein only the front legs have wheels and the output device is a single and, as in FIG. 4, a single output device is operatively connected to the sensors on the two handles.

FIG. 5 shows a third type of walker 300 having wheels 302 only on the front legs, with rubber feet 304 on the rear legs. The signal generator 306 is shown on the cross bar 308. The sensors are not visible under the grips 310, 312, and the communications links to the controller/signal generator 306 are also hidden within the frame tubing. The integration of the warning system components with the frame can be achieved at the time the walker is manufactured, whereas aftermarket kits of components can be provided for external attachment by purchasers of a standard walker.

Preferably, the warning system is activated automatically. For example, each of two independent sensor and associated signal generator can be activated to show a green color when the two handles are first grasped. When one of the users' hands is removed, the corresponding signal generator turns red. Especially for a warning system in which one signal generator processes the transmissions from both sensors, a suitable controller is included. The controller would be automatically activated when the user first grasps the handles with two hands and automatically turned off when no hand is sensed for a pre-set period, such as five minutes. Or, an on/off switch could be provided on a handle or on the controller associated with the signal generator. To avoid excessive battery drainage, the user would then be required to turn the controller off when the user is intentionally out of the walker for an extended time period.

Figure 6:
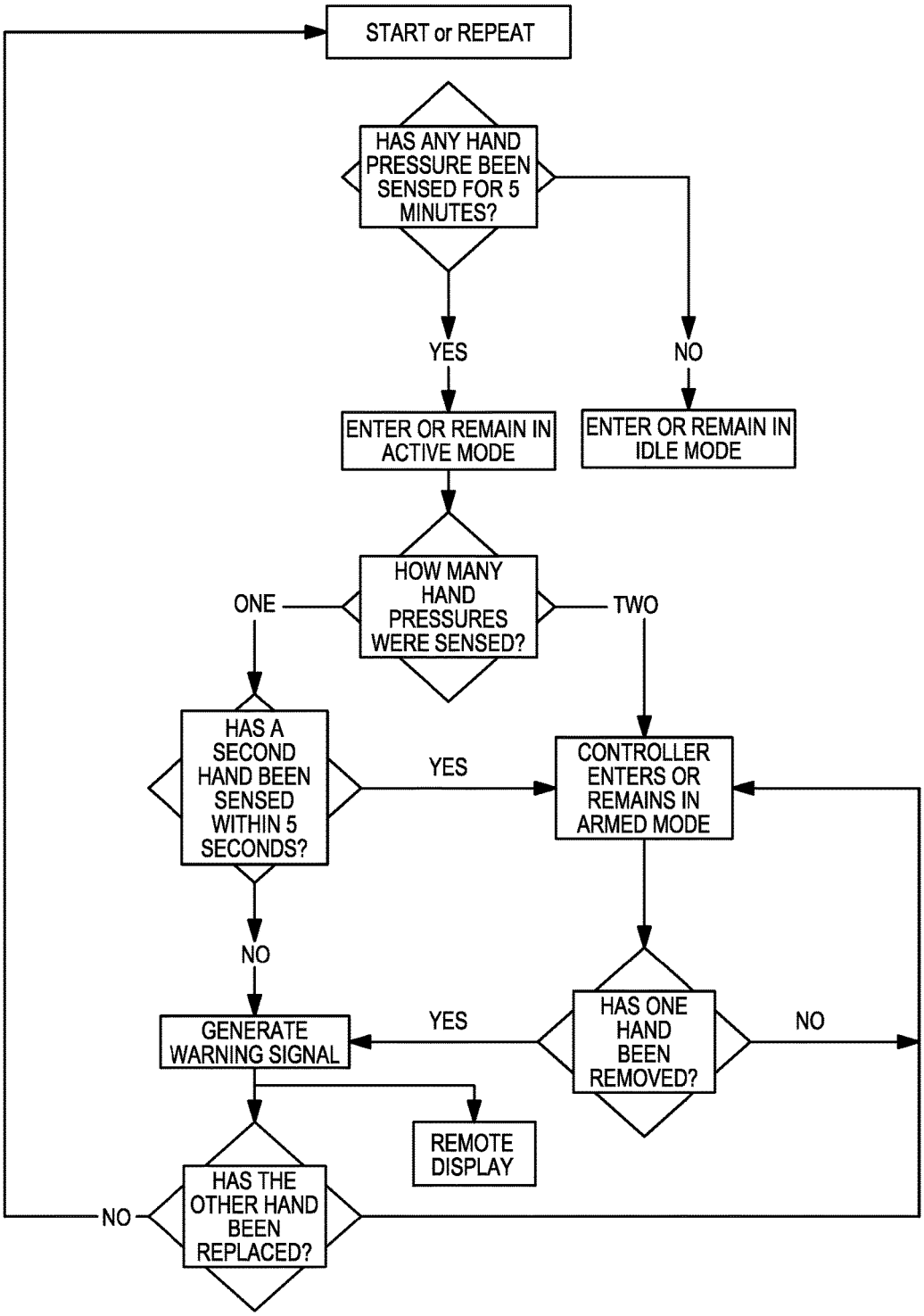
FIG. 6 is a representation of the logic associated with a fully automated warning system.

In a more automated system represented in FIG. 6, the controller is programmed with logic that does not require the user to turn the system on or off. Such controller has an idle mode, where no warning signal is generated if no hand pressure is sensed for a pre-established, long idle period of time, for example, five or ten minutes. In essence, the system is in a sleep mode. Upon the sensing of hand pressure on at least one of the handles, the controller enters an activated mode. While in the activated mode and upon sensing hand pressure on both handles, the controller enters an armed mode. While in the armed mode, the signal generator produces the warning signal to the user when the sensor on one hand senses hand pressure and the sensor on the other hand does not sense hand pressure, preferably subject to the controller imposing a pre-established user recovery delay before the signal generator produces the warning signal. The warning signal can continue for the pre-established idle period of time. In this manner, the warning signal will continue to be generated even if both hands are off the walker for the pre-established idle period of time. After that, the controller will return to the idle mode. This logic scenario contemplates that the removal of both hands from the walker was intentional and the user is safely stabilized in a chair, in bed, or the like.

The system can be expanded to include generating a remote warning or alarm for example via a wireless connection such as blue tooth. Ideally, the output device at the remote location would generate the same signal as was generated for the walker when one hand is removed from a handle. However, comprehensive programming could modify the remote output device to latch onto the warning signal after both hands have been removed (also subject to the recovery delay) but instead of returning to no signal when the controller is in an idle mode, the output warning at the remote location converts into a higher level warning or alarm and remains in that condition until reset by the caregiver or patient monitor.

Figure 7:
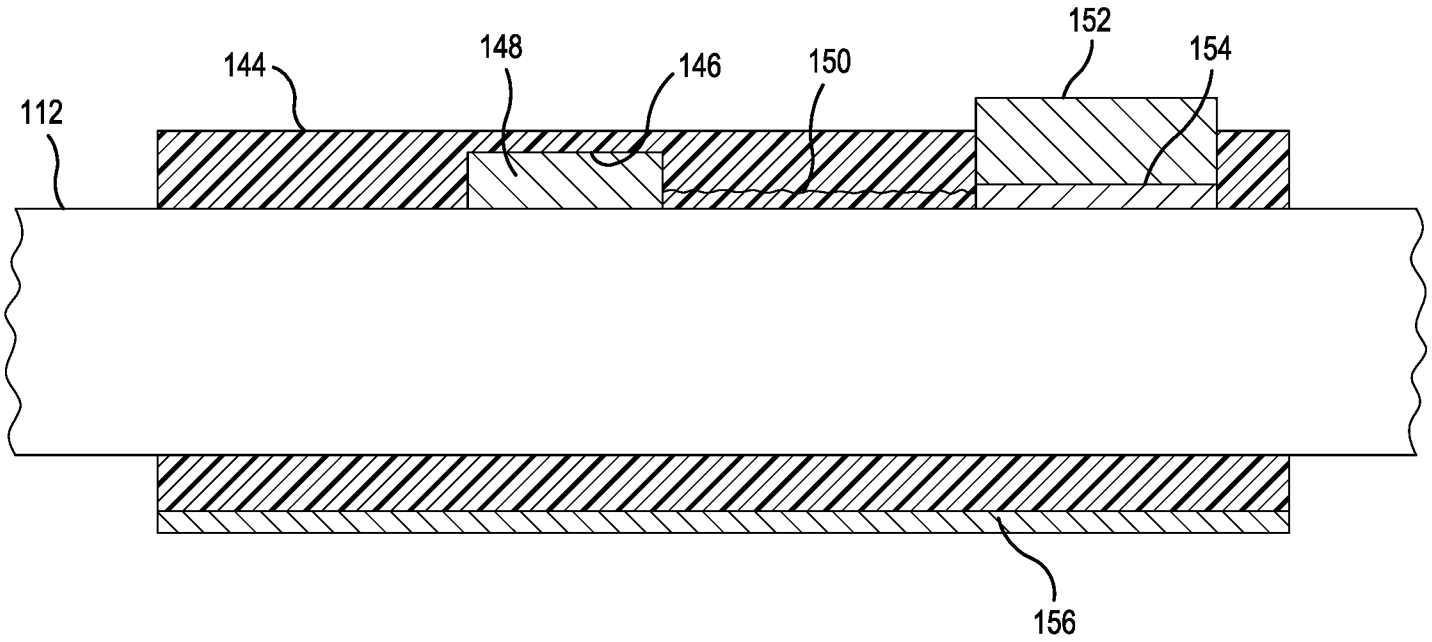
FIG. 7 shows an embodiment with a foam sleeve that supports a proximity sensor in a recess in the underside and signal generator in a recess in the outer side.

FIG. 7 shows the preferred form of implementing the simple configuration of FIGS. 2 and 3. A kit or the like includes a foam cylindrical sleeve 144 having a recess 146 in the inner surface where a tactile sensor 148 is embedded. A transmission wire 150 or the like follows the inside surface of the sleeve or preferably passes within the inner surface of the sleeve through the foam to a warning signal generator 152 that is situated in a recess 154 in the outer surface of the sleeve. In this manner, the sensor is hidden visually and physically from the user, while retaining a substantially cylindrical grip around the sensor, similar to what a user is typically accustomed to. The signal generator could optionally be fastened directly to the walker handle. The sleeve 144 can be in the form of hooks and loops on the ends of a rectangle with ends that fasten tightly 156 at the underside of the handle.

Figure 8:
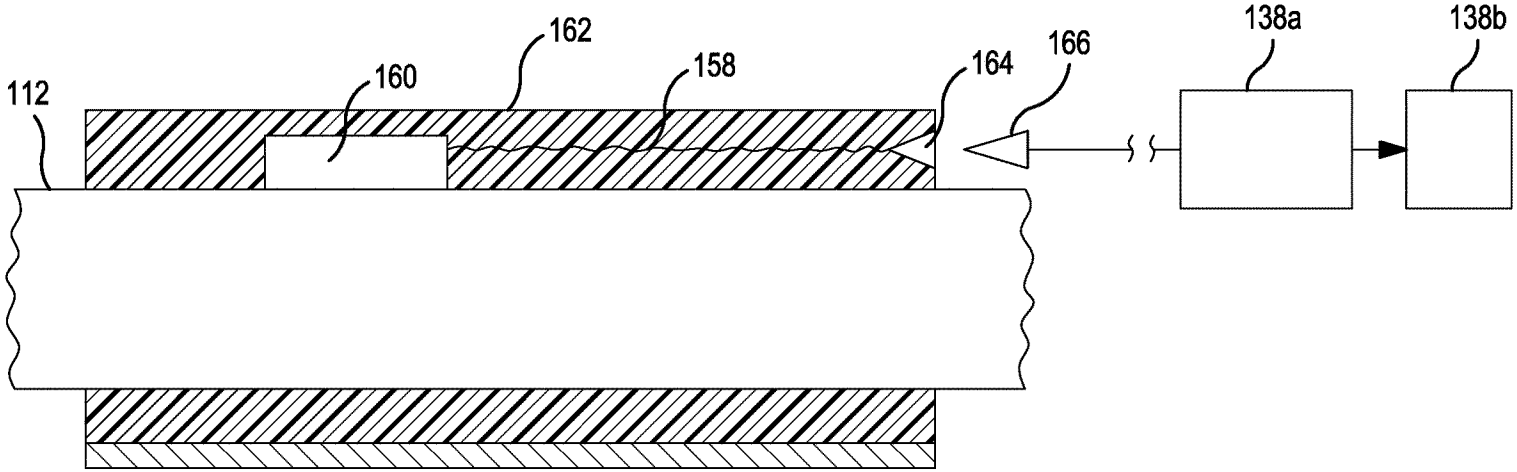
FIG. 8 shows an embodiment with a foam sleeve that supports a proximity sensor in a recess in the underside and has a frontal connector for mating with a jack in a lead from a controller.

As shown in FIG. 8, in a more complex configuration such as associated with the alternative of FIG. 1, and FIGS. 4, 5 and 6, a controller 138*a* and one signal generator 138*b* would be attachable to a central portion 116 of the walker, with the transmission wire 158 from each sensor 160 passing through the sleeve 162 to a port where a connector 164 is present for mating with a jack 166 leading to the controller.

In the embodiments depicted in FIGS. 2, 7 and 8, the batteries necessary for powering the components can be rechargeable and accessible by detachment of the hook and loop fastening to the handle.

The invention claimed is:

1. A safety walker comprising:

a plurality of legs;

a plurality of struts connecting and bracing the legs, configured to provide a space between the legs into which a user can step;

a pair of spaced apart handles supported by the legs, situated for grasping by the user while advancing the walker;

a tactile sensor situated on each handle, at a position where the user grasps the handle during use, for sensing the presence of a hand on each handle;

a transmitter associated with each sensor; and at least one signal generator responsive to the transmitters, for producing a warning signal to the user when the sensor on one handle senses the presence of a hand and the sensor on the other handle does not sense the presence of a hand on the other handle;

wherein said signal generator produces another warning signal delivered to a remote monitoring device when the sensor on one handle senses the presence of a hand and the sensor on the other handle does not sense the presence of a hand on the other handle.

2. A safety walker comprising:

a plurality of legs;

a plurality of struts connecting and bracing the legs, configured to provide a space between the legs into which a user can step;

a pair of spaced apart handles supported by the legs, situated for grasping by the user while advancing the walker;

a tactile sensor situated on each handle, at a position where the user grasps the handle during use, for sensing the presence of a hand on each handle;

a transmitter associated with each sensor; and at least one signal generator responsive to the transmitters, for producing a warning signal to the user when the sensor on one handle senses the presence of a hand and the sensor on the other handle does not sense the presence of a hand on the other handle;

wherein the presence of a hand is sensed as hand pressure, and the walker includes a controller for the signal generator, responsive to the transmitters, programmed with logic whereby in an idle mode, no warning signal is generated if no hand pressure is sensed for a pre-established idle period of time;

upon the sensing of hand pressure on at least one of the handles, the controller enters an activated mode;

while in the activated mode and upon sensing hand pressure on both handles, the controller enters an armed mode; and while in the armed mode, the signal generator produces a warning signal to the user when the sensor on one handle senses hand pressure and the sensor on the other handle does not sense hand pressure on the other handle.

3. The walker of claim 2, wherein said signal generator produces another warning signal delivered to a remote monitoring device when, in the armed mode, the sensor on one handle senses hand pressure and the sensor on the other handle does not sense hand pressure on the other handle.

4. The safety walker of claim 2, wherein the controller imposes a pre-established user recovery delay before the signal generator produces the warning signal.

5. A vertically oriented safety walker comprising:

a pair of spaced apart side frames, each having an inverted U shape with a front vertical leg, a rear vertical leg and a connecting handle spanning the legs;

a horizontal cross bar connecting the front legs;

a strut secured between the front and rear leg of each side frame, thereby forming a lightweight three-sided structure that can be deployed by entering from the rear, grasping both handles, and advancing while holding both the handles;

an instability warning system including:

a tactile sensor situated on each handle, at a position where the user grasps the handle during deployment, for sensing hand pressure on each handle;

a transmitter associated with each sensor;

at least one signal generator responsive to the transmitters, for producing a warning signal to the user when the sensor on one handle senses hand pressure and the sensor on the other handle does not sense hand pressure on the other handle; and control logic associated with the sensors, transmitters, and at least one signal generator, whereby the warning system is automatically activated when at least one sensor senses a corresponding hand on each handle and the warning system is automatically deactivated if no hand is sensed for a pre-defined idle period of time.

6. The safety walker of claim 5, wherein the control logic automatically arms the activated warning system when two hands are sensed on a respective two handles and the warning signal is generated from the armed warning system.

7. The safety walker of claim 5, including a controller responsive to all the transmitters, coupled to a single signal generator, programmed with logic whereby when the sensor on one handle senses the presence of a hand and the sensor on the other handle does not sense the presence of a hand on the other handle, the controller imposes a pre-established delay before the signal generator produces the warning signal.

8. The safety walker of claim 7, wherein the signal generator is mounted on the cross bar or a front leg.

9. The walker of claim 5, wherein the warning signal is a pre-recorded message.

10. The walker of claim 5, wherein the warning signal is visual.

* * * * *